United States Patent [19]

Taylor-Brown et al.

[11] 4,060,648

[45] Nov. 29, 1977

[54] SURFACE COATING PROCESS

[75] Inventors: Terence John Taylor-Brown, Ipswich; Paul Newton Calver, Great Bentley, both of England; James Jack, deceased, late of Mistley, England, by Margaret Jack, administratrix

[73] Assignee: Union Carbide Corporation, New York, N.Y.

[21] Appl. No.: 622,368

[22] Filed: Oct. 14, 1975

[30] Foreign Application Priority Data

Oct. 15, 1974 United Kingdom ..... 44623/74

[51] Int. Cl.[2] ..... B05D 1/06; B05D 7/04; B05D 7/14

[52] U.S. Cl. ..... 427/32; 427/33

[58] Field of Search ..... 427/14, 25, 27, 32, 427/33

[56] References Cited

U.S. PATENT DOCUMENTS

| | | | |
|---|---|---|---|
| 3,680,779 | 8/1972 | Reilly | 427/33 X |
| 3,798,048 | 3/1974 | Brody et al. | 427/25 |

*Primary Examiner*—James R. Hoffman
*Attorney, Agent, or Firm*—Eugene Lieberstein

[57] ABSTRACT

A surface coating process which comprises passing a surface to be coated past or through an excited cloud of coating material on an alternating electric field between two electrodes, one of which comprises a rotating drum onto the surface of which is metered a supply of electrically chargeable coating particles.

23 Claims, 2 Drawing Figures

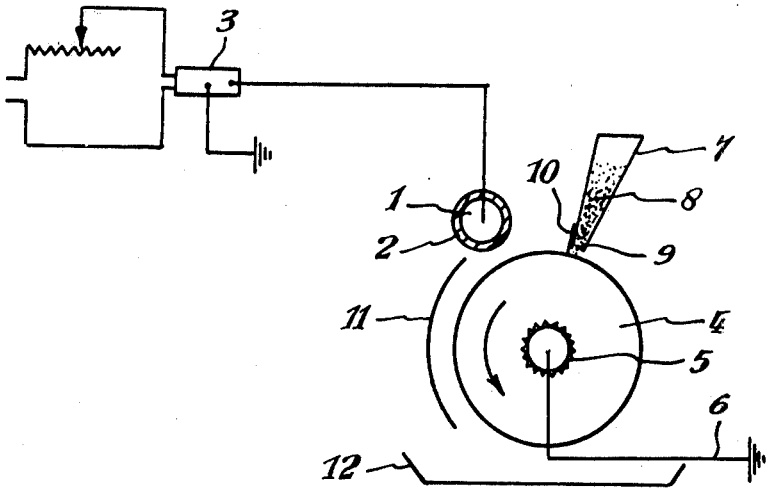
Fig. 1.
Fig. 2.
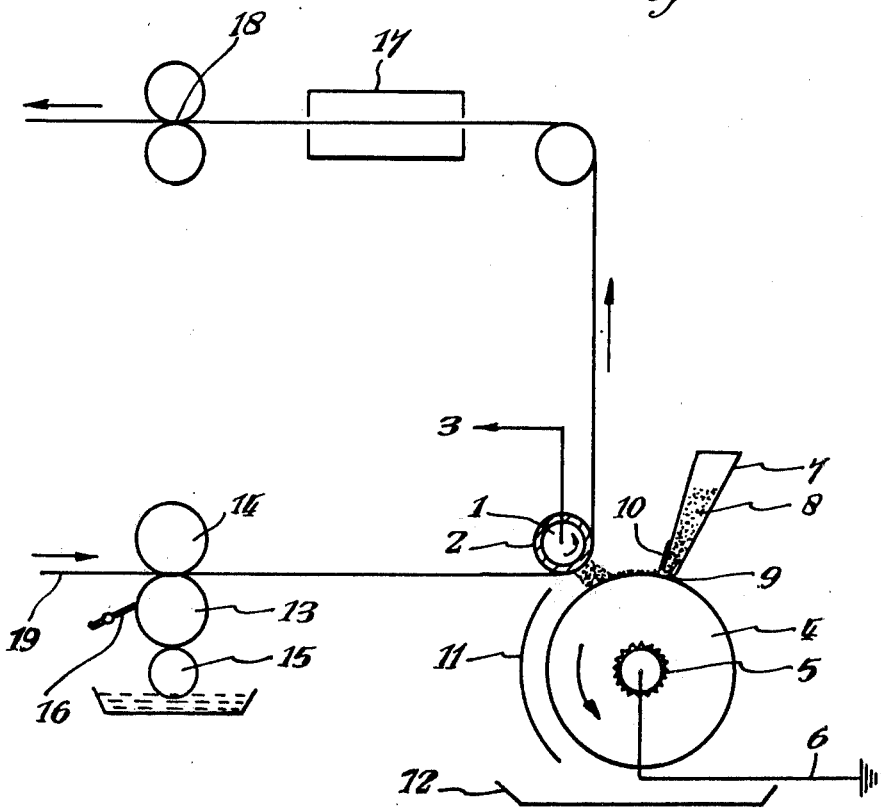

SURFACE COATING PROCESS

This invention relates to a process for coating a surface with particulate material and an apparatus for use in the process.

It has been proposed in British Patent No. 1,244,833 to provide a reflective surface on a substrate by coating the substrate with optical elements of a dielectric material by means of an electrostatic field which is formed between a plate on which a supply of the optical elements are provided and an opposed plate which bears a surface which will retain optical elements transferred thereto. The electrostatic field may be produced by pulsed extra high tension voltage, for example of between 25 and 36 KV, amplitude modulated to produce high amplitude voltage pulses, for example of between 40 and 48 KV.

This invention provides a process for coating a surface with electrically chargeable particles of material which comprises passing the surface to be coated through or past an excited cloud of the coating material, the excited cloud being formed in an alternating electric field between two electrodes, one of which comprises a rotating drum the surface of which carries a metered supply of the particles of coating material.

The invention also provides apparatus for use in the process, which comprises a first electrode in the form of a rotatable drum, means for metering electrically chargeable particles onto the surface of the drum, means for maintaining an alternating electric field between the surface of the drum and a second electrode and either means for passing a surface to be coated between the first and second electrodes or means for passing a second electrode which comprises the surface to be coated past the rotatable drum.

The process of the invention provides a very convenient, efficient and easily controlled method for bombarding a surface with a uniform cloud of particles of a coating material and for achieving a uniform coating of the material on those parts of the surface to which the particles will adhere.

The surface to be coated may be capable of complete coverage by the coating if the particles can adhere to the whole area of the surface or of partial coverage if the particles can adhere to only selected areas. Adherence of the particles may be achieved by arranging for the surface to be tackified either all over or in selected areas or by causing the particles to become tackified when they strike the surface. The surface may be tackified by heat or by providing, for example, an overall or partial coating of an adhesive or a solvent for the particles. The particles may become tackified on striking the surface if for example they are particles of a thermoplastic material and the surface is heated to a temperature at which a surface layer of the particles becomes tacky. The extent and degree of tackiness is arranged so that on bombardment of the surface by a particle cloud of given density the desired number of particles per unit area adhere to the surface. After coating a tacky surface may be rendered non-tacky by cooling, curing or drying to secure the coating of particles permanently.

The surface to be coated may be continuous or comprise discrete elements and may be passed between two electrodes or may, when it comprises, or is carried on, a conductive material, itself comprise the second electrode. When the surface to be coated is passed between two electrodes it may be passed in contact with the second electrode, in which case the second electrode preferably has a curved surface which helps to guide the passage of the surface, or it may be spaced from the second electrode.

Preferably during the process the surface to be coated is oriented so that during bombardment with the particles of coating material it faces generally downward as in this way the number of particles retained by the surface can be better controlled.

Further, if the particles are caused to move in a generally upward and downward direction loss of particles from the excited cloud due to gravity can be kept within acceptable limits.

The surface to be coated may comprise a metal such, for example, as copper, aluminium, nickel or stainless steel, or a non-metal such as paper, textile fabric, rubber or a natural or synthetic plastic material. As examples of plastic materials there may be mentioned polyvinyl chloride, polyethylene, polypropylene, linear polyester, polyurethanes, polyepoxides, unsaturated polyesters, phenol-formaldehyde resins and cellulose acetate.

The electrode(s) may, if desired, be covered by a coating of a dielectric material.

One of the electrodes is conveniently maintained at ground potential and the other electrode is connected to a source of A.C. potential which may be derived from a step-up transformer and conveniently from the output of a unit of the type commonly used for destaticising polymer films, from which the output is generally at a frequency of 50 Hertz and variable between 0 and 10 KV.

The strength of the A.C. potential required to achieve an excited particle cloud will depend on various factors including the frequency of the A.C. field, the size of the particles, the specific gravity of the material of the particles, the orientation of the electrodes, for example, whether they are horizontally opposed or vertically opposed, the separation of the electrodes and on the conductivity of the particles and the density of the field required. It has been found that an AC potential in the ranges of 2 to 10 KV at a frequency of 50 Hertz is applicable to a wide range of materials in particulate form when the particle size lies within the region up to 20 mil and for substantially vertically opposed electrodes spaced apart by a distance up to 0.3 inch. A general guide to the minimum peak electric field strength required to cause the elevation of a conductive particle into the excited cloud is obtained from the equation $E = 20. \sqrt{r\rho}$ where E is expressed in KV/cm, $r$ (radius of particle) in cm and $\rho$ (density of material of particle) in gm/cc.

The particles may be any particles which are already charged, for example, a styrene polymer or copolymer particle which has been rubbed or rolled on another surface, or particles which are electrically chargeable by the inductive effect of an electric field and in all cases should be electrically conducting through the particle and/or over the particle surface to a sufficient degree to allow sufficient transfer of charge to take place within a half cycle of the alternating field of given strength to enable the electric field to move the particle. It is believed that the particles should normally have a surface resistivity of less than $1 \times 10^{12}\ \Omega$ and/or a volume restivity of less than $10^{11}\ \Omega$ cm. Suitable particles include those with a content of a metal such, for example as aluminium, brass, copper or silver. Such particles may comprise metal alone or may comprise metal in conjunction with other material, the particles having a homogeneous or heterogeneous structure. A particular example of a heterogeneous structure is a non-conducting material such as synthetic plastic or an inorganic material such as glass which is coated with a metallic layer on its surface, rendering the surface conducting. Exemplary of such particles is the well known Ballotini, which comprises minute glass beads, which have been treated such that they individually bear an overall coating of silver. Suitable particles also include certain plastics materials such as styrene/butadiene/acrylonitrile terpolymers, polymethyl methacrylate, polystyrene, polyvinyl chloride and also certain inorganic materials other than metals, such as common salt (sodium chloride).

The means for feeding particles onto the surface of the drum electrode conveniently comprises for example, a hopper containing the particles, the hopper being designed to have a longitudinal aperture or slot at its base through which the particles may feed by gravity on to a surface of the drum. The rate at which the particles feed on to the drum may be controllable by adjustment of the slot width, the distance of the base of the hopper from the drum and the drum speed, together with means such as a doctor blade for controlling the thickness of the layer of particles on the drum surface.

The means for effecting movement of the surface or the second electrode through the apparatus may comprise any means satisfying the electrical requirements of the apparatus and may comprise merely a pair of nip rollers, a conveyor belt or the like.

The invention will now be described in greater detail by way of example with reference to the drawings in which:

FIG. 1 shows, diagrammatically, one form of the apparatus of this invention which may be employed in a process for the coating of a continuous plastics web, and FIG. 2 shows schematically a process for coating a continuous plastics web using the apparatus of FIG. 1. The same reference numerals are given to corresponding parts in each Figure.

With reference to FIG. 1 a freely rotating metal roller 1, which is preferably coated with a layer of dielectric material 2 and which is mounted in electrically isolated manner from its supporting frame-work (not shown), is connected to a variable voltage A.C. supply 3. A metal drum 4, which may also have a dielectric coating but is preferably uncoated and which is rotatable in the direction indicated, is mounted with its axis parallel to the axis of roller 1 and such that the distance between the two rollers is adjustable. Drum 4 is drivable through sprocket 5 by a variable speed motor (not shown). Drum 4 is connected to ground as indicated by 6. Hopper 7 containing electrically chargeable particles 8 has a longitudinal slot 9 at its base, the length of the slot being approximately equal to the length of drum 4 and roller 1. The effective width and length of slot 9 are adjustable by the provision of blanking-off slides (not shown). Hopper 7 is mounted above drum 4 such that the distance between slot 9 and the surface of drum 4 may be varied. Doctor blade 10 is mounted on the side of the hopper and is adjustable so that the distance of its bottom edge from the surface of drum 4 may be varied. Shield 11 is arranged to cause stray particles to fall into tray 12 to facilitate their return to hopper 7 if they are to be re-employed in the process.

In operating the apparatus in FIG. 1, electrically chargeable particles 8 are put into hopper 7 and drum 4 is set rotating in the direction indicated. Hopper 7, slot 9 and doctor blade 10 are adjusted so that a layer of particles 8 of the desired thickness is applied to the surface of drum 4. The A.C. voltage from supply 3 is then applied to roller 1 and adjusted until an excited particle cloud is formed, the particles of which bombard the surface of roller 1. The intensity of bombardment and the cloud density may be varied by varying the A.C. potential but this can only be increased as far as the number of particles within the influencing distance of the field will allow; the intensity can be varied further by altering the distance between roller 1 and drum 4, and/or by altering the thickness of the layer of particles on the surface of drum 4 and/or by altering the speed of drum 4.

FIG. 2 shows, diagrammatically, one arrangement incorporating the apparatus in FIG. 1 and which may be used for applying electrically conducting particles, for example, to the surface of a plastics web 19, which has been tackified, for example, with a solvent or adhesive. In FIG. 2, plastics web 19, fed from a supply (not shown) is passed between gravure roller 13 and rubber back-up roller 14 which causes tackified areas to be formed on the surface of the web. Tackifying agent is applied and metered on to the gravure roller via applicator 15 and doctor knife 16. The tackified sheet is passed round roller 1 and then to an adhesive drying or curing stage depicted generally by 17, the web being drawn through the apparatus by driven nipped rollers 18. The sheet 19 is passed through an excited cloud of particles formed in the manner described with reference to FIG. 1. The variables of the apparatus are adjusted to maintain a substantially uniform cloud of the desired density as the web passes through the apparatus and becomes bombarded and coated in its tackified areas with the particles.

Although the apparatus as described with reference to FIG. 1 in particular is clearly applicable to sheets of flexible material, it will be understood that the process and apparatus of the invention may be adapted for coating continuous substantially rigid substrates by, for example, replacing roller 1 by a flat platen electrode. Individual flexible plates may be bombarded in a substantially continuous process by attaching the plates to an endless band passing through the apparatus of FIG. 2 in place of web 19, arranged for only the plates to be tackified and providing for a plate removal stage beyond stage 17.

In the apparatus described the application of the A.C. potential to roller 1 which is otherwise electrically isolated is largely for convenience and it would be possible to apply the A.C. potential to drum 4, which should then be otherwise electrically isolated, while keeping roller 1 at ground potential. Similar possibilities arise when the surface to be coated is itself the second electrode, but in this case it is generally more convenient and safer to apply the A.C. potential to an otherwise electrically isolated drum 4.

It will be evident from the foregoing that if, for example, an article to be bombarded is situated in spaced relationship between at least two electrodes and a differential A.C. potential is applied between them or between each electrode and the article, particle clouds may be generated on more than one side of the article in the general manner described and bombardment of the article from at least two directions achieved. It will also be evident that if, for example, an article with a highly conductive internal electrode is surrounded in spaced relation by a second electrode and the differential A.C.

potential applied to the electrodes, a particle cloud may be generated which encircles the article. The latter arrangement may be employed, for example, for bombarding the surface of a cylinder.

When bombardment of an article occurs from more than one direction, the arrangement is preferably such that the minimum bombardment of the article occurs in a downward direction. In this way, the number of particles retained by the surface of the article may be better controlled.

The following Examples illustrate the process and apparatus of the present invention.

EXAMPLE 1

A web of polished, flexible polyvinyl chloride containing 52 parts by weight of plasticizer per 100 parts of resin of width 13.75 inches and thickness 0.008 inch was continuously fed from a reel and through the apparatus as shown in FIG. 2 and in place of web 19 as shown.

The gravure roller 13 situated approximately 20 inches from roller 1 had a screen size of 200 cells per linear inch and an etched cell depth of 0.0015 inch. The tackifying agent employed consisted of a solution of 20 parts by weight of VMGH resin (supplied by Bakelite Xylonite Limited) in a solvent mixture comprising by volume 43% methyl ethyl ketone, 43% toluene and 14% methyl cyclohexanone. The flexible web, tackified in discrete areas printed by the gravure roller, was passed around roller 1, which consisted of steel covered with 0.35 inch of Mintite rubber 2 having a hardness of 78° Shore giving the roller, including its covering, a total diameter of 2 inches. The roller 1 is isolated from the framework of the apparatus by 0.5 inch thick insulating blocks. The length of the covered roller was 14.25 inches, thus allowing 0.25 inch margins at each side of the web as it passed over the covered roller. The web was then led through a hot air oven to dry the adhesive on the web before batching.

The drum 4, of diameter 10 inches, length 16.5 inches and comprised of smooth turned steel, was situated such that its axis was parallel to that of the covered roller and the minimum separation of the surfaces of drum and covered roller was 0.3 inch, but also such that the axis of the covered roller was displaced 2.4 inches from the vertical centre-line of the drum 4 and on the same side as the gravure roller.

Hopper 7, having a height 4.5 inches and top rectangular aperture 15 inches × 3.5, inches was positioned such that the doctor blade 10, 15 inches long and consisting of 0.010 inch spring steel spaced 0.10 inch from the leading edge of the bottom aperture of the hopper and mounted on a rigid carrier, contacted drum 4 vertically at a position 0.125 inch from the vertical centre line of the drum and on the same side of that centre-line as the gravure roller. Doctor blade 10 was raised to form a parallel separation of its linear edge from the surface of the drum of 0.0035 inch. The base of hopper 7 was arranged such that the edge of the rectangular aperture, 0.3 inch × 15 inches in its base, closest to the doctor blade was 0.010 inch from the surface of the drum 4. With this arrangement, when the hopper was filled with conductive particles comprising Ballotini beads of average diameter of approximately 0.0025 inch which had been treated to provide each with an overall coating of silver in the manner described in Example 1 of British Pat. No. 1389021, an excess was supplied to the doctor blade which metered the particles into a monolayer. Drum 4 was then rotated at a speed of 0.6 r.p.m. in the direction shown and a 50 Hertz A.C. 10 KV potential was then applied to the steel roller 1, causing the particles to form a consistent substantially uniform excited cloud. Those particles which attained sufficient velocity to bombard the tackified surface of the web which was arranged to travel through the apparatus at a speed of 30 ft per min. were held by the tackifying agent and carried out of the cloud, which was continuously replenished by the metered feed layer on rotating drum 4. The web after drying had a uniformly distributed monolayer of silvered Ballotini secured to its surface and provided a useful precursor in the manufacture of retro-reflective materials.

EXAMPLE 2

Example 1 was repeated but replacing the silvered Ballotini in successive operations A, B and C by the following:

| Material | Designation | Supplier | Particle size |
|---|---|---|---|
| A) PVC suspension polymer | Breon S 125/11 | BP Chemicals (UK) Ltd., Devonshire House, Piccadilly, London W1 | Less than 0.005" as supplied |
| B) High density polyethylene powder | NEWS0515 T-13238-4 | Unifos Kemi ab Stenungsund, Sweden | Sieved to less than 0.007" |
| C) Sodium Chloride | General purpose reagent | Hopkin & Williams Ltd. Chadwell Heath, Essex | Less than 0.020" as supplied |

The conditions employed were identical to those employed in Example 1 except for the following:

| Operation | Doctor blade clearance | Charged roller/ Grounded drum gap |
|---|---|---|
| A | 0.010" | 0.125" |
| B | 0.014" | 0.125" |
| C | 0.040" | 0.125" |

The products from operations A, B and C had very uniform coatings modifying the surface properties of the PVC web.

EXAMPLE 3

Example 1 was repeated but replacing the silvered Ballotini by a powder prepared from the following composition.

| | Parts by weight |
|---|---|
| Alresen 609R 89958 (supplied by Chemische Werke Albert) a phenolic resin of melting point about 80° C | 95 |
| Tioxide RCR - 2 TS19126 (supplied by British Titan Products Co. Ltd.) | 5 |

The Tioxide was mixed into the molten resin at 80° C to form a uniform mixture which was then cooled and crushed to a powder. The powder was sieved to obtain particles passing through a 0.015 inch mesh but being retained by 0.007 inch mesh for use in the Example.

Further, the PVC web employed in Example 1 was replaced by a web comprising Astralux 98 gsm One Sided White Paper (supplied by Wiggins Teape Paper Ltd.), oriented such that the treated surface was the surface which would be coated in operating the process of the invention according to this Example. Also, the coated roller 1 employed in Example 1 was replaced by a 2 inch diameter coated roller of length 6 inches and comprising a steel core and a 0.2 inch thick PTFE (polytetrafluoroethylene) sleeve. Other departures from the conditions employed in Example 1 were as follows:

| Doctor blade clearance | Charged roller/grounded drum gap | Web speed |
|---|---|---|
| 0.015 inch | 0.125 inch | 5 ft/min. |

The dried coated product was found to have a uniformly dispersed monolayer of particles adhered to its surface modifying the surface properties.

EXAMPLE 4

The apparatus employed in Example 3 was modified by the replacement of the tackifying agent applicator 15, gravure roller 13, doctor blade 16 and rubber back-up roller 14 by a pair of first nip rollers, the speed of which could be varied. Further, two ceramic heaters each $4\frac{3}{4}$ inches $\times$ $2\frac{1}{4}$ inches and rated at 500 watts were situated, in combination, longitudinally of one another and facing in a generally upward direction, with $\frac{3}{4}$ inch between them, and such that the end of one of the heaters was 2 inches from the surface of roller 1. The heaters and first nip rollers were further arranged such that the edge of the heater combination nearest roller 1 would be approximately 0.4 inch from the surface of a web passing between the first nip rollers and the coated roller 1, the web making an angle of 40° with the horizontal, and such that the edge of the heater combination most remote from roller 1 would be 2.5 inches from such web. The drying stage 17 was replaced by cooling means comprising means to circulate air over a coated web to cool it.

The web employed in Example 3 was replaced by a tape of width 1 inch and thickness 0.020 inch and comprising high density polyethylene. The particles employed in this Example comprised a powder substantially identical to that employed in Example 3 and the conditions employed to obtain and maintain the excited cloud were also as employed in that Example.

The polyethylene tape was passed through the first nip rollers, over the heaters, around roller 1 through the cooling means and finally through driven nipped rollers 18 driven such that the speed of the tape through that nip was approximately 5 ft/min. The speed of the first nip rollers was adjusted to maintain the tape in slight tension as it passed through the apparatus. With the heaters and cooling means in operation and the excited cloud formed and maintained, the cooled tape after passage through the apparatus was found to have a uniformly dispersed monolayer of opaque particles fused to and modifying its surface.

EXAMPLE 5

A 0.008 inch thick laminated web of width 13.75 inches and comprising a glossy surfaced high density polyethylene layer bonded to a 0.0005 inch thick aluminium foil was continuously fed from a reel and through the apparatus employed in Example 1 modified as described below, with the aluminium foil layer initially upper-most.

The apparatus employed in Example 1 were modified in that an air blower was situated between the tackifier applicator and the roller 1. Further, roller 1 was completely electrically isolated and the 50 Hertz A.C. 10 KV potential was applied to the drum 4 which was otherwise electrically isolated; hopper 7, shield 11 and tray 12 were also electrically isolated. Driven nipped rollers 18 comprised a lower steel roller for contacting the aluminium layer of the web, grounded electrically, and an upper rubber back-up roller.

Operation of the apparatus was substantially as described in Example 1 with the exceptions that are made apparent below.

The tackifying agent employed was Kurt Herberts E.P. Normal adhesive which is a two part solvent-based polyurethane adhesive supplied by Campbell Technical Waxes Ltd. The surface of the high density polyethylene layer was printed in discrete areas, by the gravure roller, with the adhesive solution. The solvent was removed from the printed solution by passing the web over the air blower situation between the applicator and roller 1. The thus tackified web then passed around roller 1 and then, after passage over a further roller, passed through a hot air oven set at 60° C to cure the adhesive, being pulled through the apparatus by the driven nipped rollers 18 beyond which the web was reeled.

The silvered Ballotini employed in Example 1 was replaced by high density polyethylene powde NEWS-O515T-13238-4 as described in Example 2. In operation of the apparatus, the doctor blade clearance was arranged to be 0.014 inch and the minimum separation of the surface of drum 4 from the outer surface of the web passng around roller 1 was about 0.12 inch.

The coated surface of the product obtained exhibited reduced gloss.

EXAMPLE 6

Example 5 was repeated substantially as described with the exceptions that the web was passed through the apparatus with the high density polyethylene layer initially upper-most. Further, the driven nipped rollers 18 were arranged such that the grounded steel roller was upper-most and the rubber back-up roller lower-most. In operation the minimum separation of the surface of drum 4 from the outer surface of the web passing around roller 1 was about 0.15 inches.

The coated surface of the product obtained exhibited a higher coefficient of friction than a similar but uncoated aluminium surface.

We claim:

1. A process for coating a surface with electrically chargeable particles of material, which comprises passing the surface to be coated through or past an excited cloud of coating material having a surface resistivity of less than $10^{12}\Omega$ or a volume resistivity of less than $10^{11}\Omega$ cm., the excited cloud having been formed in an alternating electric field between two electrodes, one of which comprises a rotating drum which carries a metered supply of the particles of coating material.

2. A process as claimed in claim 1, wherein the surface to be coated is electrically conducting or is carried on an electrically conducting backing and itself forms the second electrode.

3. A process as claimed in claim 1, wherein the surface to be coated is passed between two electrodes.

4. A process as claimed in claim 1, wherein the surface to be coated is the surface of a continuous web.

5. A process as claimed in claim 1, wherein the surface to be coated is oriented so that during bombardment by the particles it faces generally downwards.

6. A process as claimed in claim 1, wherein the particles in the excited cloud are caused to move in a generally upward and downward direction.

7. A process as claimed in claim 1, wherein the surface to be coated is a metal surface.

8. A process as claimed in claim 7, wherein the metal is selected from the group consisting of copper, aluminium, nickel and stainless steel.

9. A process as claimed in claim 1, wherein the surface to be coated is a non-metal surface.

10. A process as claimed in claim 9, wherein the non-metal surface is selected from the group consisting of paper, textile fabric, rubber, natural plastic material and synthetic plastic material surfaces.

11. A process as claimed in claim 10, wherein the non-metal surface is a synthetic plastic material selected from the group consisting of polyvinyl chloride, polyethylene, polypropylene, linear polyester, polyurethane, polyepoxide, unsaturated polyester, phenylformaldehyde resin and cellulose acetate surfaces.

12. A process as claimed in claim 1, wherein one electrode is maintained at ground potential and the other electrode is connected to the means for applying the alternating voltage.

13. A process as claimed in claim 2, wherein the alternating voltage is applied to the rotatable drum which is otherwise electrically isolated.

14. A process as claimed in claim 1, wherein the particles have a surface resistivity less than $10^{12}\Omega$.

15. A process as claimed in claim 1, wherein the particles have a volume resistivity less than $10^{11}\ \Omega$ cm.

16. A process as claimed in claim 1, wherein the particles comprise an inorganic material.

17. A process as claimed in claim 16, wherein the particles have at least a content of metal.

18. A process as claimed in claim 17, wherein the metal is selected from the group consisting of aluminium, brass, copper and silver.

19. A process as claimed in claim 17, wherein the particles comprise a core of a non-conductive material which is coated with a layer of a metal.

20. A process as claimed in claim 19, wherein the non-conducting core is a glass core.

21. A process as claimed in claim 16, wherein the particles are particles of sodium chloride.

22. A process as claimed in claim 1, wherein the particles comprise a synthetic plastics material.

23. A process as claimed in claim 22, wherein the plastics material is selected from the group consisting of a styrene/butadiene/acrylonitrile terpolymer, polymethyl methacrylate, polystyrene, a vinyl chloride polymer, an ethylene polymer and a phenolic resin.

* * * * *